United States Patent [19]

McKenzie

[11] Patent Number: 4,924,733

[45] Date of Patent: May 15, 1990

[54] MULTIPLE BIT SCREWDRIVER

[76] Inventor: Archibald M. McKenzie, 1705-1552 Esquimalt Ave., West Vancouver, British Columbia, Canada, V7V 1R3

[21] Appl. No.: 287,610

[22] Filed: Dec. 16, 1988

Related U.S. Application Data

[63] Continuation of Ser. No. 897,736, Aug. 18, 1986, abandoned.

[30] Foreign Application Priority Data

Aug. 16, 1985 [CA] Canada ..... 488931

[51] Int. Cl.[5] ..... B25B 25/00

[52] U.S. Cl. ..... 81/438; 81/439; 81/177.4; 81/490

[58] Field of Search ..... 81/177.4, 437, 438, 81/439, 490

[56] References Cited

U.S. PATENT DOCUMENTS

| | | | |
|---|---|---|---|
| 733,126 | 7/1903 | Bellows . | |
| 1,418,184 | 5/1922 | Trunick | 81/438 |
| 1,712,343 | 5/1929 | Gerhardt . | |
| 3,006,395 | 10/1961 | Dye | 145/63 |
| 3,405,749 | 10/1968 | Butler | 145/63 |
| 3,753,455 | 8/1973 | Butler | 145/63 |
| 4,010,663 | 3/1977 | Rydberg | 81/71 |
| 4,235,269 | 11/1980 | Kraus | 81/438 |
| 4,253,356 | 3/1981 | Martinmaas | 81/177 N |
| 4,327,790 | 5/1982 | Stevens et al. | 145/62 |
| 4,434,828 | 3/1984 | Trincia | 145/62 |
| 4,440,048 | 4/1984 | Stevens | 81/440 |
| 4,463,788 | 8/1984 | Corona et al. | 145/63 |
| 4,480,668 | 11/1984 | Lin | 145/63 |

*Primary Examiner*—Judy Hartman

*Attorney, Agent, or Firm*—Marger & Johnson, Inc.

[57] ABSTRACT

A Multiple Bit Screwdriver has a handle with a plurality of bits in a circular array of longitudinal bores within a handle magazine. A rotatable end cap on the handle is provided with a slot for receiving the bit, and the desired bit is selected by rotating the end cap to align the slot with a particular bore. The selected bit is withdrawn from the magazine by inserting a second bit into the bore through the slot in the end cap, thereby forcing the selected bit out of the bore through the opposite end. The bit is retained in working position on the screwdriver shaft by magnetic means. Double-ended bits may be utilized.

11 Claims, 5 Drawing Sheets

A
B
C
19
11
13
15
17
2
33
73
74
75
77
79

MULTIPLE BIT SCREWDRIVER

This is a continuation of co-pending application Ser. No. 897,736, filed on Aug. 18, 1986, now abandoned.

1. Field of the Invention

The invention pertains to screwdrivers and more particularly to screwdrivers having handles for storing multiple interchangeable bits.

2. Brief Description of the Prior Art

The variety of screwdriver bit sizes and types which are required for most purposes makes it practical and economical to utilize a screwdriver handle having interchangeable bits. Various designs are in use wherein a single screwdriver handle can be fitted with multiple interchangeable bits where such bits can be stored in the handle, thereby reducing the number and expense of screwdriver tools required to drive the various sizes and head configurations of screws. In the most common of these designs, the multiple bits are stored loosely in a hollow handle. To select a particular bit, an end cap on the handle is unscrewed, all the bits are removed from the handle, the desired bit is selected and secured in a chuck, the remaining bits are returned to the handle and the end cap is replaced. The problem with this design is that the bits are frequently dropped and misplaced, and on some models the handle itself is not well suited for the manual act of driving the screw as the end cap may become loosened while the handle is being turned.

Various handle configurations have been suggested which involve storing the multiple bits securely in the handle and utilizing some mechanism to transfer the selected bit to the chuck. Most of these are too cumbersome to use and expensive to manufacture to have achieved acceptance An example is the multi-chambered tool holder described in U.S. Pat. No. 3,405,749 issued Oct. 15, 1968 to Butler which utilizes an arrangement which requires manipulating bits to fall out of or back into the handle through a rotatable disc and a cone-shaped end piece before or after being secured in the chuck end.

Another proposed solution is that disclosed in U.S. Pat. No. 4,434,828 issued Mar. 6, 1984 to Trincia. In this design, the bits are stored in the handle in transverse bores in transverse orientation with respect to the long axis of the screwdriver. The bores have sleeves of resilient material which hold the bits in place by friction. To remove one of the bits for use the user removes the bit previously used and presses it into the opening in the sleeve holding the desired bit, thereby freeing the desired bit and storing the bit previously used. The selected bit is secured to the end of the screwdriver shaft by a magnet.

This arrangement has a number of problems. The length and number of bits which can be used is limited by the width and length of the screwdriver handle respectively. The embodiment shown in the patent has only four bits, which is too few for the full variety of screw heads encountered. Double-ended bits are less practical in the Trincia design due to the limitation on the length of the bits. A further problem lies in the visibility of the stored, recessed bits when a selection is made. Finally, in the Trincia design, one hand is holding the screwdriver while the other is pushing out the selected bit from above, and with nothing to hold the selected bit once it has been displaced it is liable to be dropped.

SUMMARY OF THE INVENTION

The present invention overcomes the aforementioned problems by providing a multiple bit screwdriver wherein the bits are held in a circular array of bores in the transparent handle of the screwdriver parallel to the longitudinal axis of the screwdriver. The bit which is in use is held in the screwdriver shaft by a magnet. A rotatable end cap is provided with a slot whereby when a bit is selected, the slot in the end cap is aligned with the bore holding the bit, and the previously used bit is inserted into the bore, thus displacing the selected bit so that it can be readily grasped. The magnet holds the displaced bit on the screwdriver until it is removed. Double-ended bits may be used in this arrangement to double the number of bits available. Means may be provided to lock the end cap in position and also to hold the selected bit in the handle until it is removed.

According to a further aspect of the invention, the rotatable end cap may be dispensed with, leaving the ends of the longitudinal bores open. Also, the means for retaining the bit in the screwdriver shaft may comprise a hexagonal socket with an exterior co-axial tube capping the socket and having a hexagonal opening. The tube is spring-biased to rotate the hexagonal opening into and out of alignment with the hexagonal socket. The bias is such that the opening is out of alignment with the socket when the external tube is released, and consequently when a hexagonal-ended bit is inserted through the opening into the socket and the external tube is released, a frictional pressure is applied to the bit which retains it in the socket.

According to a further aspect of the invention, the longitudinal bores may not extend completely through the handle, but may only extend part-way from the nose piece, which itself is provided with a longitudinal bore and rotates separately from the handle. According to this aspect of the invention the nose piece is spring-biased to hold it into the position selected while allowing it to be rotated to a new position.

BRIEF DESCRIPTION OF THE DRAWINGS

In drawings which illustrate an embodiment of the invention.

DETAILED DESCRIPTION OF A PREFERRED EMBODIMENT

Figure 1:
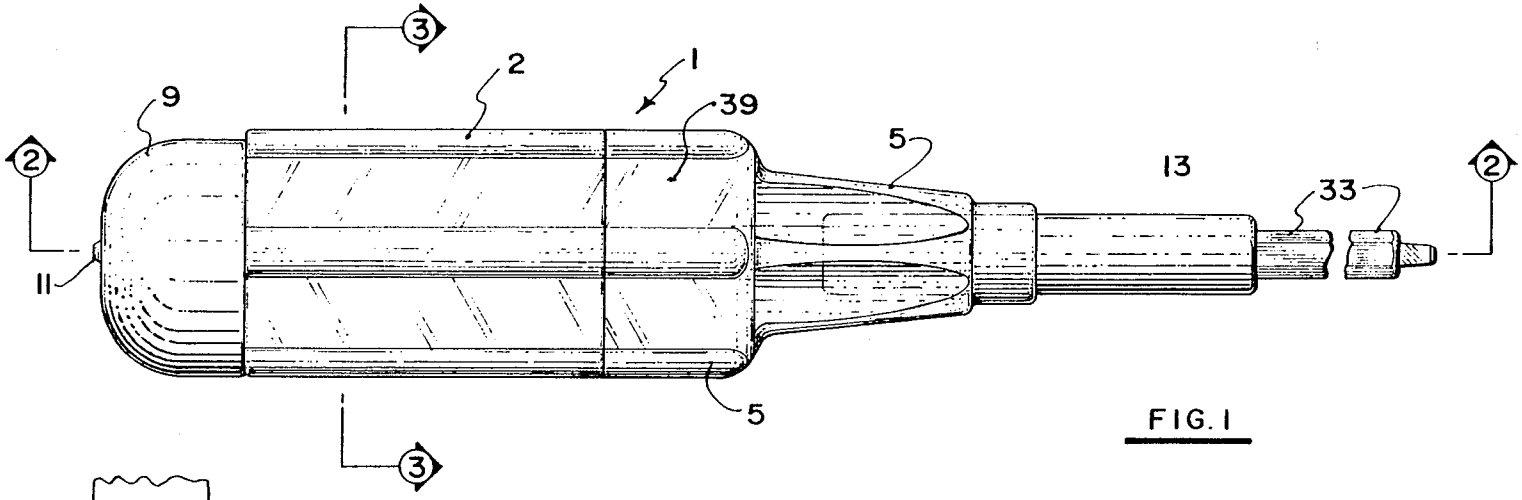
FIG. 1 is a plan view of the screwdriver of the invention.
Figure 2:
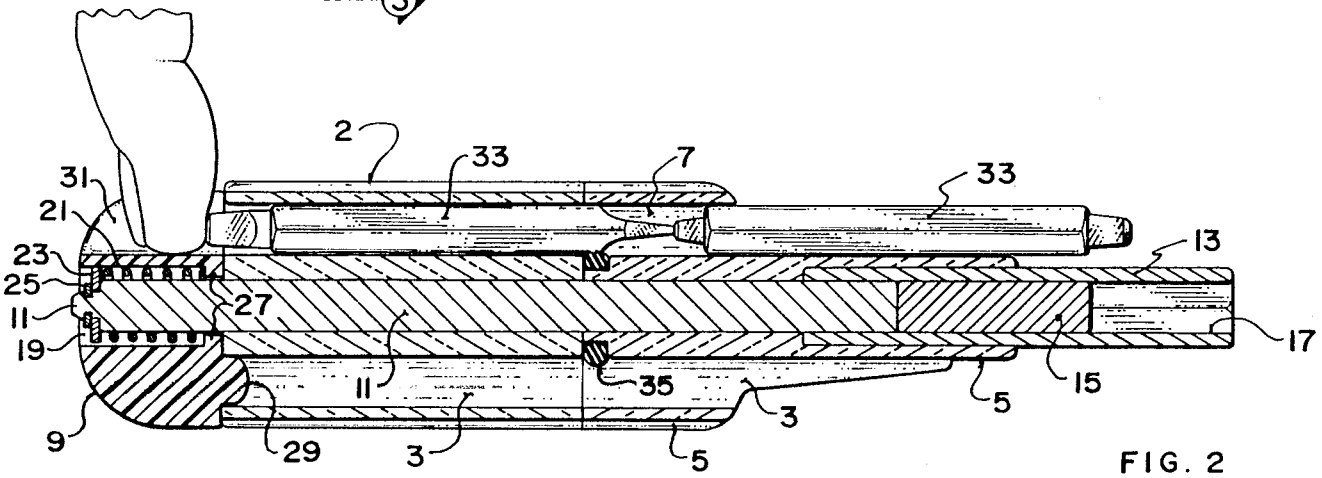
FIG. 2 is a cross-sectional view of an embodiment of the invention taken along lines II—II of FIG. 1 and showing the process of selecting a bit.
Figure 5:
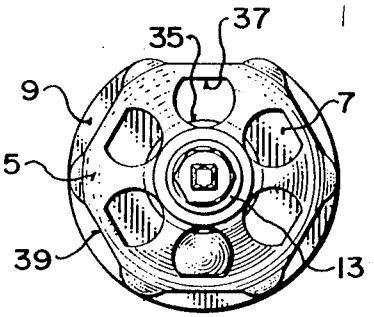
FIG. 5 is a right end view of the screwdriver of the invention.

Referring to FIGS. 1 and 2, the screwdriver 1 of the invention has a handle section 2 made of transparent plastic and having longitudinal bores 3, a nose piece 5 also composed of a transparent material and also having longitudinal bores 7, and end cap 9. Handle sections 2 and 5 are attached to hexagonal metal shaft 11. Also secured to shaft 11 is end tube 13 which is provided with a magnet 15 and hexagonal bore 17. End cap 9 has central bore 19 in which is situated coil spring 21. Washer 23 is secured to the end of shaft 11 by clip 25 and bears against one end of coil spring 21. End cap 9 has surface 27 at one end of bore 19 which bears against the opposite end of coil spring 21. End cap 9 also has a circular knob 29 which fits into the end of one of the longitudinal bores 3.

Figure 4:
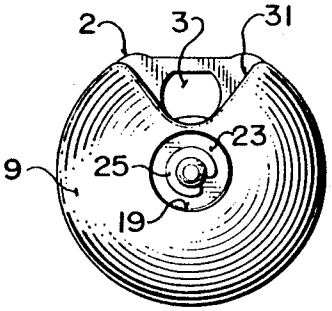
FIG. 4 is a left end view of the end of the screwdriver of the invention.

Looking at FIG. 4, the end cap 9 is provided with a slot 31 which may be aligned with bore 3 when knob 29 is disposed in the end of another bore. Slot 31 can be aligned with any particular bore by pulling the end cap away from handle section 2, thus compressing coil spring 21 and removing knob 29 from bore 3. The end cap may then be rotated to align the slot 31 with the desired bore and released to return knob 29 to be secured in the end of a bore by the coil spring.

In operation, each bore 3 will have stored in it a single or double-ended screwdriver bit 33. The operating bit 33 is held in the end of shaft 13 by magnet 15 and is prevented from rotating by the hexagonal shape of bore 17 which conforms with the hexagonal shape of bit 33 and which is sized to fit the bit snugly. Six bits 33 are stored in the handle section 2 of the screwdriver. These bits are initially loaded into the handle by inserting each bit individually through slot 31 in the end cap and then successively rotating the end cap to the next bore 3 for loading the next bit. The bits are prevented from falling out of the handle by virtue of frictional contact with a rubber O-ring 35 around shaft 11 which projects a small distance into bores 3 through a small slot in the walls of the bores.

Figure 7:
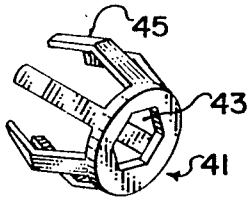
FIG. 7 is a perspective view of the retaining spring shown in FIG. 8.
Figure 6:
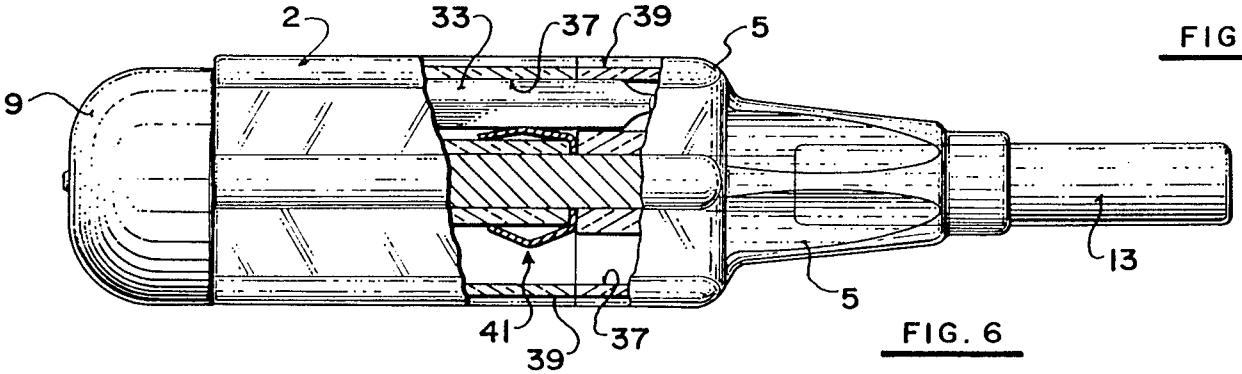
FIG. 6 is a perspective view of the invention partially cut away to show the interior retaining spring.

Alternatively, a leaf spring 41 adapted to lie in a slot in each bore could be used to retain the bits in each bore. The leaf spring is shown in FIG. 7. It has a central aperture 43 to receive central shaft 11 and six spring arms which extend into each bore and bear against a stored bit to permit it to slide easily in the bore but preventing the bit from falling out of the bore.

Referring to FIG. 2, to select a new bit, the operating bit 33 is remOved from the end of shaft 13. The ends of the stored bits may be easily viewed by the user due to the transparency of the handle. The desired bit is selected as indicated above by rotating the end cap 9 to align slot 31 with the bore in which the desired bit is stored. The previous operating bit is then inserted through slot 31 into bore 3, thereby displacing the newly selected bit which is pushed through bore 7 in nose piece 5. Bore 7 is of the same diameter as bore 3, and the magnet 15 in tube 13 holds the newly selected bit in place against the nose piece until the user pulls it out of the handle and places it into bore 17 in the end of the screwdriver shaft 13.

Figure 3:
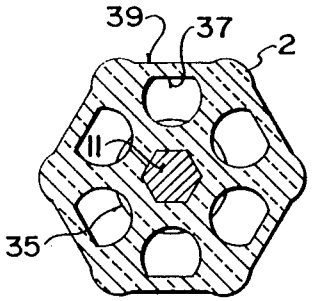
FIG. 3 is a cross-sectional view taken along lines III—III of FIG. 1.

It can be seen that in this manner the user has potentially fourteen different screwdriver ends which can be selected. Because the handle section 2 is transparent, the bit ends are easily viewable for purposes of selection. The refractive effects of the plastic are minimized by the cross-sectional shape of handle section 2 as shown in FIG. 3 wherein surfaces 37 and 39 are flat.

A second embodiment of the invention is shown in FIGS. 8 through 13. In this embodiment, the rotatable end cap is dispensed with. The longitudinal bores 3 extend completely through the handle 2 and are open at either end. This design has a cut-out in the handle at 50 which allows the bit ends to be visible when stored. The stored bits are retained by a retaining spring 52 or by a rubber O-ring at the same location resulting in retention due to friction. A bit is selected by removing the working bit from the chuck and inserting it into the end of the opening 54 in which the selected bit is retained. The selected bit is thereby ejected from the bore, where the previous working bit has now replaced it, and is displaced to a position in bore 53 where it is retained by friction with O-ring 55. O-ring 55 may also function appropriately if located at 57. The user then pulls the selected bit from the end of bore 53 and mounts it in the chuck.

Figure 8:
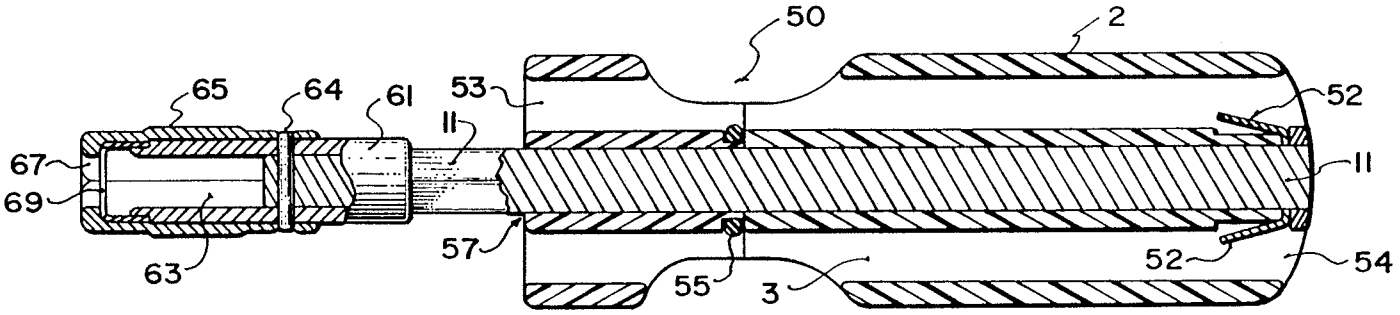
FIG. 8 is a cross-sectional view of a second embodiment of the invention taking along lines A—A of FIGS. 9 and 10.
Figure 10:
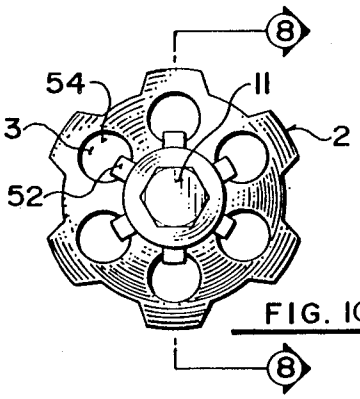
FIG. 10 is a right-end view of the screwdriver shown in FIG. 8.
Figure 9:
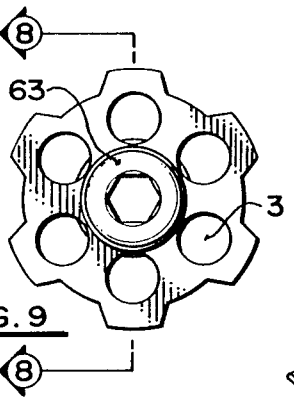
FIG. 9 is a left-end view of the screwdriver shown in FIG. 8.
Figure 11:
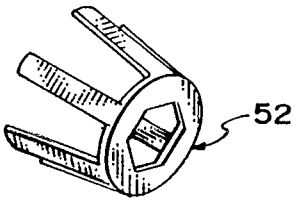
FIG. 11 is a perspective view of the retaining spring shown in FIG. 10.
Figure 8A:
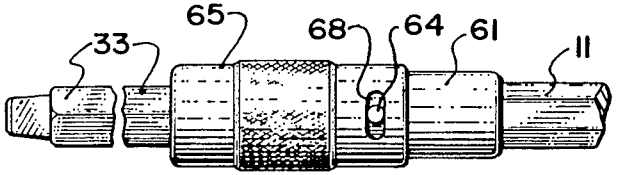
FIG. 8A is a side view of the chuck of the embodiment of the invention shown in FIG. 8 with a bit in place.
Figure 12:
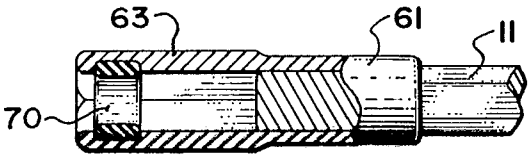
FIG. 12 is a front view, partially cut-away of a further variation of the chuck shown in FIG. 8, partially cut-away in cross-section.
Figures 13, 13A, 13B, 13C, 14, 15, 16, 17, 18, 19:
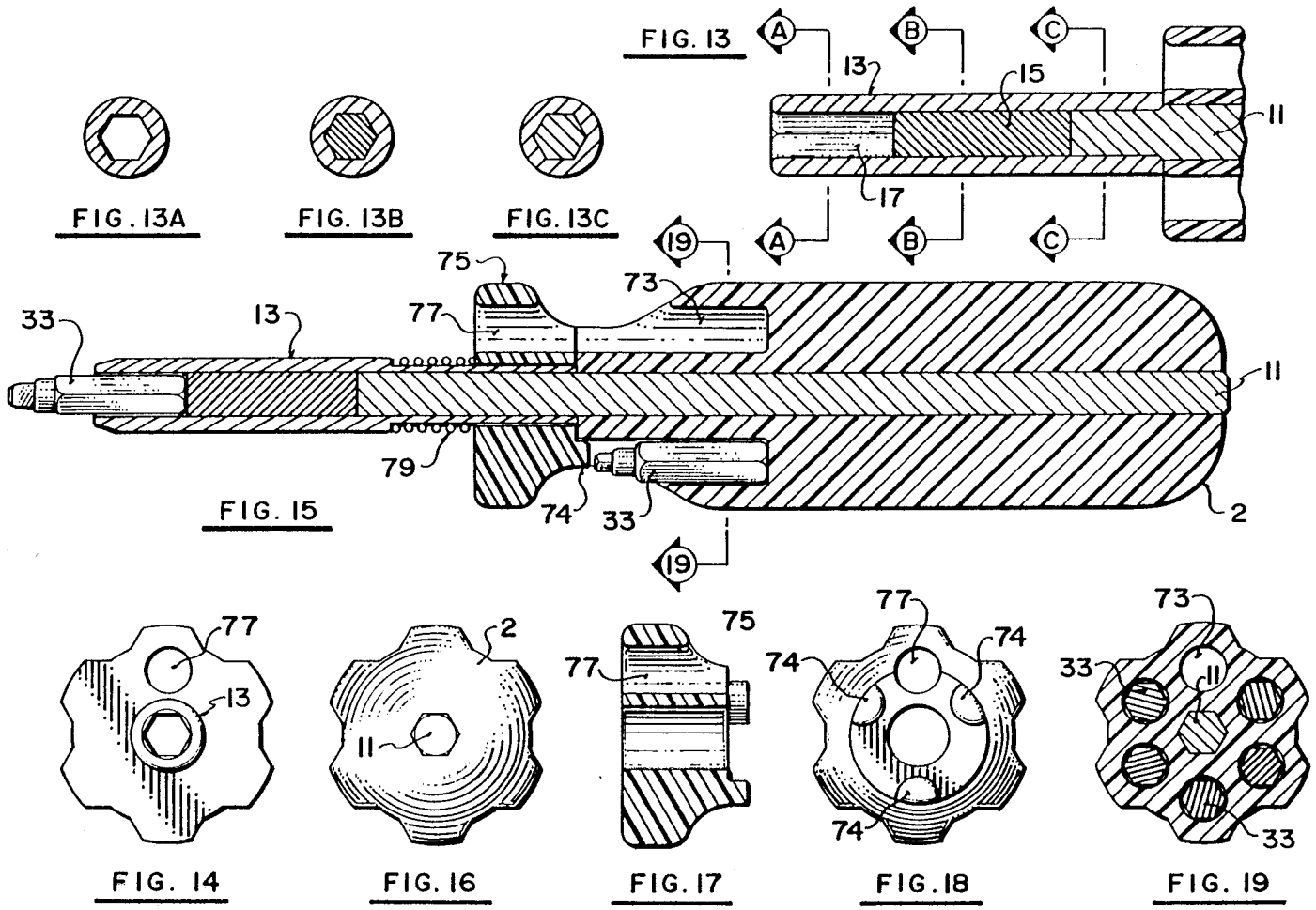
FIG. 13 is a cross-sectional view of a magnetic chuck as shown in FIG. 2.
FIG. 13A is a cross-sectional view taken along line E—E of FIG. 13.
FIG. 13B is a cross-sectional view taken along line F—F of FIG. 13.
FIG. 13C is a cross-sectional view taken along line G—G of FIG. 13.
FIG. 14 is a front view of a third embodiment of the invention.
FIG. 15 is a longitudinal cross-sectional view of a third embodiment of the invention.
FIG. 16 is a right end view of the embodiment of the invention shown in FIG. 15.
FIG. 17 is a cross-sectional view of the nose piece of FIG. 15.
FIG. 18 is an end view of the nose piece shown in FIG. 17.
FIG. 19 is a cross-sectional view taken along line VI—VI of FIG. 15.

While the previous magnetic chuck (shown in cross-sectional detail in FIGS. 13, and 13*a*, 13*b* and 13*c*) may also be used in this embodiment, FIG. 8 shows an alternative form of chuck. Referring to FIG. 12, this chuck consists of a hexagonal socket 61 which is mounted on hexagonal shaft 11. The hexagonal bore 63 in the socket is sized to receive the hexagonal end of a bit. A cap 65 having a hexagonal opening 67, also sized to receive the bit, is mounted on the end of the socket. The cap has an opening 68 to receive a pin 64 which extends from and is fixed on the end of the socket. This allows the cap a certain limited freedom of rotation on the end of the shaft. The spring 69 biases the cap in one rotational direction. To mount a bit in the chuck, the user rotates the end cap until the hexagonal opening in the cap is aligned with the hexagonal socket, inserts the hexagonal end of the bit and releases the cap. The spring then causes the cap to rotate out of alignment with the socket, causing a frictional retention of the bit.

FIG. 12 shows a further variation on the chuck shown in FIG. 8. In this variation, a rubber sleeve 10 is located in the socket which is appropriately sized to provide sufficient friction to retain the bit in the socket, yet allow it to be inserted and removed.

The foregoing variations on the chuck design are advantageous for the embodiment shown in FIG. 8 due to the fact that fairly long bits are required in that embodiment, accordingly the advantage of a magnetic chuck, namely that the magnetization reaches the screw being worked on to retain it on the end of the bit, is not as significant.

FIGS. 14 through 19 show a further variation of the invention. In this variation the bores 73 do not extend completely through handle 2, but only extend to the depth of a short bit from the left-hand end of the handle. A nose piece 75 rotates separately on the shaft and is biased against the handle by spring 79. The nose piece is provided with one bore 75 which may be aligned with one of the six bores in the handle in order to select a bit. The bits remain stored loosely in bores 73. To select a bit, the working bit 33 is replaced into bore 73 in the handle through bore 77, nose piece 75 is moved against the spring 79 to remove knobs 74 from the ends of bores 73, nose piece 75 is rotated to align bore 77 with the selected bit, and the nose piece is released allowing knobs 74 to return into the ends of bores 73. The selected bit then simply drops out of bore 73 by tilting the screwdriver and the bit is placed in the end of the chuck, which may take the form of one of the chucks described above.

As will be apparent to persons skilled in the art, various modifications and adaptations of the structure above described are possible without departure from the spirit of the invention, the scope of which is defined in the appended claims.

The embodiments of the invention in which an exclusive property or privilege is claimed are defined as follows:

1. A multiple bit screwdriver comprising:
(a) a handle provided with a plurality of bores arrayed circumferentially about and parallel to the longitudinal axis of the said handle, each said bore being open at both ends thereof and adapted to store a screwdriver bit;
(b) a shaft secured to and extending from one end of said handle;
(c) means provided at one end of said shaft for securing said screwdriver bit; and
(d) means for releasably retaining said bit in said bores comprising an array of metal bands spaced radially about and fixed to a common circular element, one end of each of said band being fixed to said common element and the other end being free and located within said bores at a location spaced towards said one end of said handle from said fixed end of said band;

wherein a selected bit is removed from its bore by inserting a second bit into an open end of the bore containing said selected bit and forcing said second bit into said bore thereby displacing said selected bit.

2. A multiple bit screwdriver comprising:
(a) a handle provided with a plurality of bores arrayed circumferentially about and parallel to the longitudinal axis of said handle, each said bore being open at both ends thereof and adapted to store a screwdriver bit;
(b) a shaft secured to and extending from one end of said handle;
(c) means provided at one end of said shaft for securing said screwdriver bit; and
(d) means for releasably retaining said bit in said bore;

wherein a selected bit is removed from its bore by inserting a second bit into an open end of the bore containing said selected bit and forcing said second bit into said bore, thereby displacing said selected bit, and wherein an outer annulus of said handle is cut away in an area adjacent to but spaced from one end of said handle, thereby dividing each of said bores into a first longer bore furthest from said one end and a second shorter bore adjacent said one end, the length of said longer bore being comparable to the length of said bit, and the length of said shorter bore being shorter than the length of said bit.

3. The screwdriver of claim 2 comprising first a means for releasably retaining said bit in said first bore and second means for releasably retaining said bit in said second bore.

4. The screwdriver of claim 3 wherein said first and second means for releasably retaining said bit comprise flexible means associated with each said first and second bore fixed to the inner surfaces of and extending into each of said bores, and adapted to bear against and frictionally engage said bit when bit is stored in said bores, and to permit sliding movement of said bit when said bit is inserted into or displaced from said bores.

5. A multiple bit screwdriver comprising:
(a) a handle;
(b) a shaft secured to and extending from, one end of said handle;
(c) means provided at one end of said shaft for securing a screwdriver bit;

wherein said handle is provided with a plurality of bores arrayed circumferentially about and parallel to the longitudinal axis of said handle, each said bore being open at both ends thereof and adapted to store a screwdriver bit, each said bore comprising first and second bit-retaining sections, said first bit-retaining section comprising a temporary bit-holding portion closest to said bit-securing means, and said second bit-retaining section comprising a bit storage portion furthest from said bit securing means; said temporary bit-holding portion having a length less than the length of said bit;
(d) means for releasably retaining said bit in said temporary holding portion; and
(e) means for releasably retaining said bit in said bit storage portion.

6. The screwdriver of claim 5 wherein said bit storage portion has a length comparable to the length of said bit.

7. The screwdriver of claim 5 wherein said bit storage portion has a length approximately equal to or greater than the length of said bit.

8. The screwdriver of claim 5 wherein said temporary bit-holding portion and said bit-storage portion are separated by an annular cut-away section of said handle.

9. The screwdriver of claim 5 wherein said means for releasably retaining said bit in said temporary holding portion and said means for releasably retaining said bit in said bit storage portion comprises flexible means associated with each said bore fixed to the inner surface of and extending into each of said bores, and adapted to bear against and frictionally engage said bit when said bit is stored in said bore, and to permit sliding movement of said bits when said bits are inserted to or displaced from said bore.

10. The screwdriver of claim 9 wherein said flexible means comprises a band having one end secured to said inner surface of said bore and a second free end located within said bore at a located spaced towards said one end of said handle from said fixed end of said band.

11. The screwdriver of claim 10 wherein said means for releasably retaining said bit comprises an array of metal bands spaced radially about and fixed to a common circular element, one end of each of said bands being fixed to said common element and the other end being free and located within said bores at a location spaced towards said one end of said handle from said fixed end of said band.

* * * * *